United States Patent [19]

Haisch

[11] Patent Number: 4,831,947

[45] Date of Patent: May 23, 1989

[54] TWO-NEEDLE OVEREDGE SEWING MACHINE WITH APPARATUS FOR SEWING IN THREAD CHAIN

[75] Inventor: Gert Haisch, Stuttgart, Fed. Rep. of Germany

[73] Assignee: Union Special G.m.b.H, Stuttgart, Fed. Rep. of Germany

[21] Appl. No.: 150,272

[22] Filed: Jan. 29, 1988

[30] Foreign Application Priority Data

Feb. 19, 1987 [DE] Fed. Rep. of Germany ..... 3705263

[51] Int. Cl.[4] ..... D05B 1/20; D05B 1/22

[52] U.S. Cl. ..... 112/197; 112/165; 112/286

[58] Field of Search ..... 112/165, 197, 162, 288, 112/286

[56] References Cited

U.S. PATENT DOCUMENTS

| | | | |
|---|---|---|---|
| 3,123,033 | 3/1964 | Weigert | 112/197 |
| 3,698,336 | 10/1972 | Launer | 112/286 |
| 4,072,116 | 2/1978 | Nagy | 112/286 |
| 4,149,478 | 4/1979 | Sanvito et al. | 112/288 X |
| 4,220,105 | 9/1980 | Palacino | 112/288 X |
| 4,303,030 | 12/1981 | Palacino et al. | 112/286 |

FOREIGN PATENT DOCUMENTS

| | | | |
|---|---|---|---|
| 672198 | 5/1952 | United Kingdom | 112/288 |

*Primary Examiner*—Andrew M. Falik

*Attorney, Agent, or Firm*—Emrich & Dithmar

[57] ABSTRACT

A device for a two-needle overedge sewing machines for sewing in a thread chain. The device has a pair of needles, and a pair of slots in a needle plate for the needles. The device further has a pair of stitch formation tongues, and a directing mechanism in order to guide the thread chain into a needle hole slot between one of the stitch formation tongues.

4 Claims, 3 Drawing Sheets

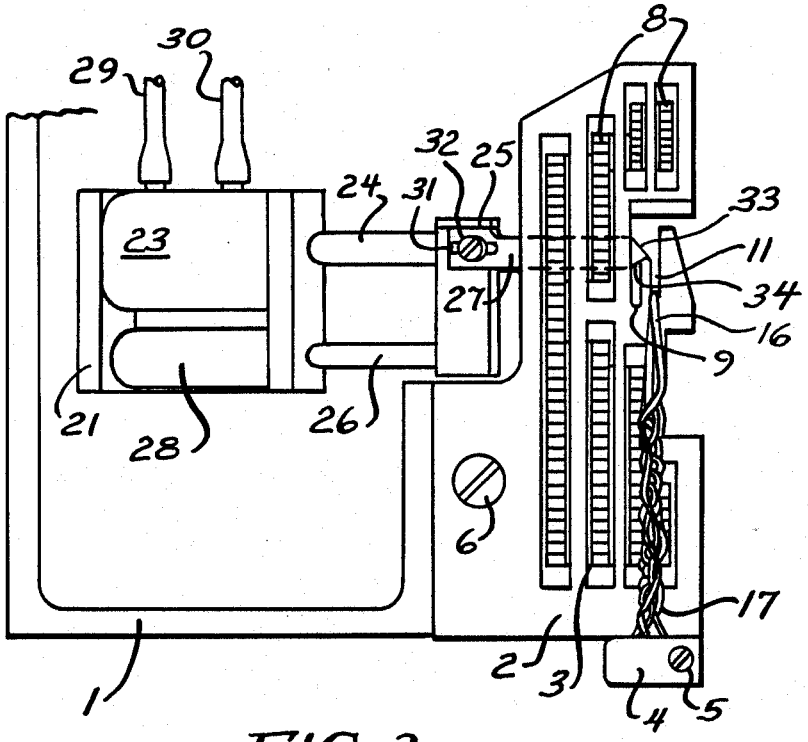
FIG. 3
FIG. 4
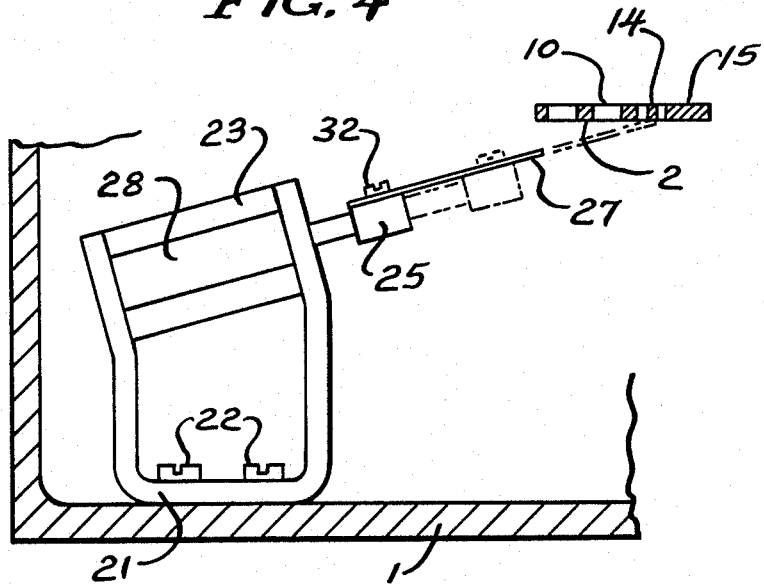

TWO-NEEDLE OVEREDGE SEWING MACHINE WITH APPARATUS FOR SEWING IN THREAD CHAIN

BACKGROUND OF THE INVENTION

The present invention relates to a device for two-needle overedge sewing machines for sewing in the thread chain at the beginning of a seam.

Such a device is described, for example in DE-OS 3033187. In this device, the sewing threads of the thread chain are guided by means of a fixed deflector device on the needle plate into the needle hole slot between two stitch formation tongues while the work material is being turned, in order to ensure correct insertion of the thread chain. This fixed deflector device prevents the thread chain sliding off the stitch formation tongues during sewing and produces an irregular seam on the material. Furthermore, such a deflector device does not perform its deflection function in the optimum way. Correct grouping of the threads into the needle hole slot between the two stitch tongues is thus very much dependent on the skill of the sewing machine operator, and if the threads are grouped incorrectly, this leads to impaired sewing in of the thread chain into the seam. This constitutes a reduction in quality of the finished work material.

SUMMARY OF THE INVENTION

A principal feature of the present invention is the provision of an improved device for two-needle overedge sewing machines for sewing in the thread chain at the beginning of a seam.

The device of the invention for a two-needle overedge sewing machine for sewing in the thread chain, which has previously been cut off at a predetermined length, at the beginning of a seam, in which the machine has a needle plate with a needle hole slot for each needle comprises, a stitch formation tongue between the two needle hole slots, and a stitch formation tongue adjacent to the needle hole slot nearer the edge of the work material, a thread chain holding device for directing and holding the thread chain, which is folded back against the direction of material feed, and a directing mechanism having controlled displaceable directing means disposed in the region of the stitch formation tongue lying between the needle hole slots in order to guide the thread chain, which is formed around the stitch formation tongues, into the needle hole slot between the two stitch formation tongues after being removed from the stitch formation tongues.

A feature of the invention is that the device enables the beginning of the thread chain to be sewn at the beginning of the same in a manner which is of simplified construction and which does not reduce the quality of the finished work material.

Another feature of the invention is that the controllably movable directing means of the directing mechanism which is only temporarily in the region of the stitch formation tongue between the needle hole slots, safely guides the thread chain, once it has been removed from the stitch formation tongues, into the needle hole slot between the two stitch formation tongues. During the sewing operation, stitch formation is not impeded because the directing means is disposed outside the stitch formation area.

Yet another feature of the invention is that needle plates can thus be used which are also used in sewing operations in which there is no sewing in of the thread chain at the beginning of the seam. As a result, storage of replacement parts subject to wear is simplified, because special needle plates with deflector devices are not required.

Further features will become more fully apparent in the following description of the embodiments of this invention and from the appended claims.

DESCRIPTION OF THE DRAWINGS

In the drawings:

FIG. 3 is a plan view of the said part of the sewing machine with the thread chain folded back against the direction of material feed, with the thread ramp in the operating position; and FIG. 4 is a sectional view through the sewing machine taken substantially as indicated along the line 4—4 in FIG. 2, wherein the thread ramp is in the resting position, and the dash-dotted line shows its operating position.

DESCRIPTION OF THE PREFERRED EMBODIMENTS

Figure 1:
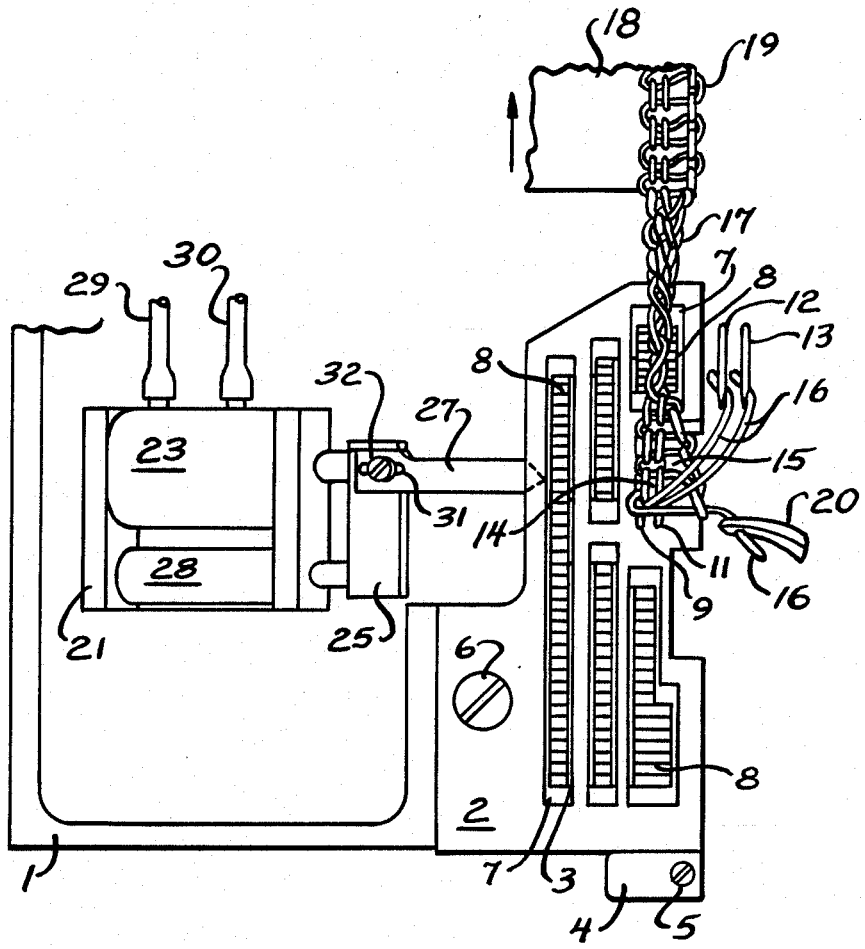
FIG. 1 is a plan view of a part of a sewing machine in the region of the stitch formation point, wherein the work material has been chain-stitched, with the needles and looper shown out of position, and a thread director is in a resting position.

The part of an overedge sewing machine show in FIG. 1 comprises part of a housing 1, a needle plate 2, a feed dog 3 and a thread chain holding device 4, which has a screw 5. The needle plate 2 is attached by a screw 6 to the housing 1 and has slots 7 for feed dogs 8. It also has needle hole slots 9 and 11, through which pass needles 12 and 13 (shown out of position so as not to obscure the aforementioned parts), and a top surface 10 (FIG. 4). A stitch formation tongue 14 lies between the needle hole slots 9 and 11, and a further stitch formation tongue 15 lies adjacent to the needle hole slot 11, as can also be seen in FIG. 2.

Sewing threads 16 form a thread chain 17 around the stitch formation tongues 14 and 15, which chain forms an overedge seam 19 on a piece of work material 18. Two of the threads 16 are fed by the needles 12, 13 and a third sewing thread 16 is guided by a looper 20.

Figure 2:
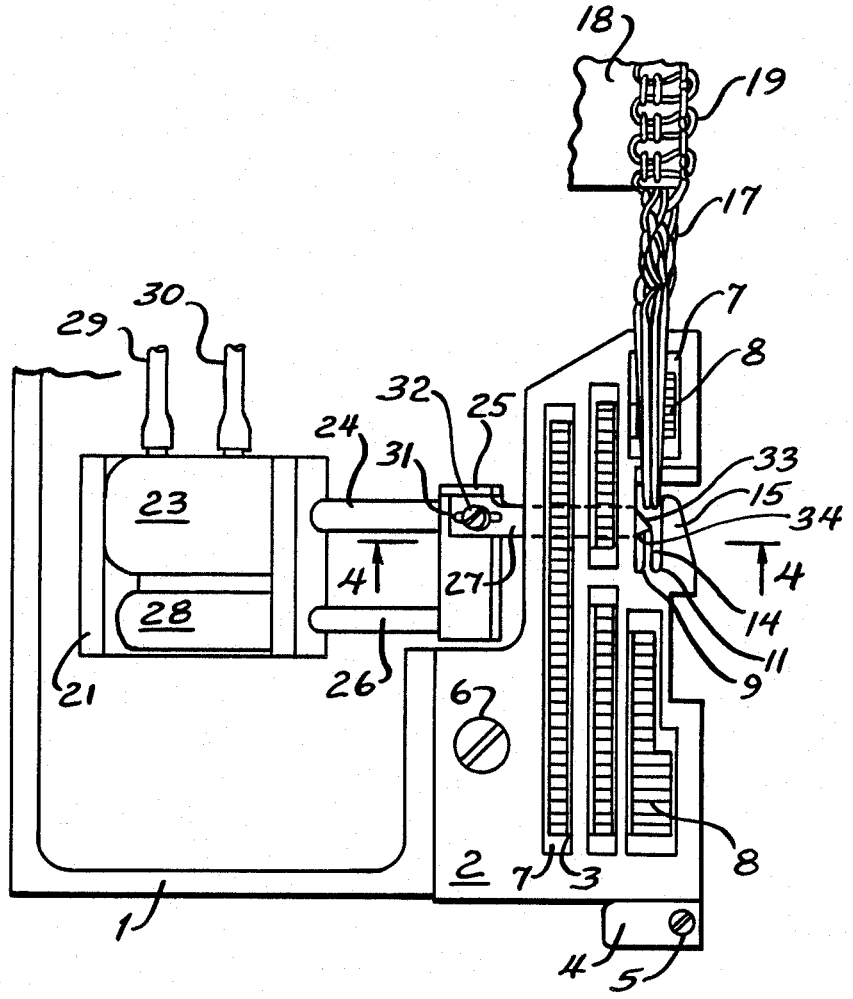
FIG. 2 is a plan view of the said part of the sewing machine following removal of the thread chain from the stitch formation tongues, wherein the thread ramp is in an operating position.

The sewing machine has a thread directing mechanism described as follows. A holder 21 is fastened by two screws 22 to the housing 1. The holder 21 bears a cylinder 23 with a piston rod 24. The piston rod 24 is connected by way of a carrier 25 to a further rod 26, which serves as a parallel guide for a thread ramp 27. The rod 26 projects into a receiving element 28. The cylinder 23 receives a pressure medium by way of a tube 29 or 30. The thread ramp 27 has a slot 31 and is fastened to the carrier 25 by a screw 32 received through the slot 31. The free end of the thread ramp 27 has slide or ramp surfaces 33 and 34, which guide the thread chain 17, as shown in FIGS. 2 and 3, into the needle hole slot 11.

A control device ensures that either the tube 29 or the tube 30 is supplied with pressure medium, and, as a result, the connecting rod 24 is either retracted or extended, and hence the thread ramp 27 is either in a normal inoperative position or in an operating position.

FIG. 1 shows conventional stitch formation around the stitch formation tongues 14 and 15 during a sewing operation. The thread ramp 27 is in the normal inoperative position and thus does not impede stitch formation. Following termination of the sewing operation, the said control device is activated and the thread ramp 27 moves into the operating position (FIG. 2). The sewing threads 16 are then pulled off the stitch formation tongues 14 and 15 in the direction of material feed as indicated by the arrow in FIG. 1. This is facilitated by opening brake discs of needle thread tensioning brakes. At the same time, the slide surface 34 urges the sewing thread 16 removed from the needle hole slot 9 towards the needle hole slot 11.

If the work material 18 is then folded back in a conventional manner against the direction of material feed, such as disclosed in U.S. Pat. No. 3,123,033, at column 4, lines 3 to 8, the sewing threads 16 are guided, as shown in FIG. 3, by way of the slide surface 33 of the thread ramp 27 into the right-hand side needle hole slot 11, that is to say, that needle hole slot which is nearer the edge of the work material 18, and reclamped by the thread chain holding device 4 to impart a defined direction of the chain.

Following this operation, the thread chain 17 is cut from the work material 18 and can thus be inserted into the beginning of the seam of the following piece of work material.

The foregoing detailed description is given for clearness of understanding only, and no unnecessary limitations should be understood therefrom, as modifications will be obvious to those skilled in the art.

What is claimed is:

1. A device for a two-needle overedge sewing machine having a direction of material feed for sewing in a thread chain, which has previously been cut off at a predetermined length, at the beginning of a seam, in which the machine has a pair of needles, a needle plate with a pair of needle hole slots with one for each needle, a stitch formation tongue between the two needle hole slots, and a stitch formation tongue adjacent to the needle hole slot nearer the edge of the work material, said pair of needles forming a thread chain around the stitch formation tongues, means for removing the thread chain from the stitch formation tongues, a thread chain holding device for directing and holding the thread chain, which is folded back against the direction of material feed, and a directing mechanism having controlled displaceable directing means disposed in the region of the stitch formation tongue lying between the needle hole slots in order to guide the thread chain, which is formed around the stitch formation tongues, into the needle hole slot between the two stich formation tongues after being removed from the stitch formation tongues.

2. A device for sewing in the thread chain as claimed in claim 1, in which the directing means of the directing mechanism is a thread ramp, which is movable beneath the top surface of the needle plate.

3. A device for sewing in the the thread chain as claimed in claim 2, in which the thread ramp has at least one slide surface, which guides the thread chain into the needle hole slot between the two stitch formation tongues.

4. A device for sewing in the thread chain as claimed in claim 1, in which the directing mechanism has a rod which can be reciprocated in a controlled manner.

* * * * *